United States Patent [19]

Kelley et al.

[11] Patent Number: 4,723,932

[45] Date of Patent: Feb. 9, 1988

[54] TOY DOLL HAVING ARTICULATED ARMS AND A TILTABLE UPPER TORSO

[75] Inventors: William J. Kelley, Torrance; Mark Wittenberg, Anaheim; Ryszard Brzezinski, Long Beach, all of Calif.

[73] Assignee: Mattel, Inc., Hawthorne, Calif.

[21] Appl. No.: 880,858

[22] Filed: Jul. 1, 1986

[51] Int. Cl.[4] ..... A63H 3/20; A63H 3/46

[52] U.S. Cl. ..... 446/330; 446/336; 446/376

[58] Field of Search ..... 446/330, 317, 322, 331, 446/332, 334, 335, 345, 354, 336, 376, 383, 268, 272, 274, 288, 294

[56] References Cited

U.S. PATENT DOCUMENTS

| | | | |
|---|---|---|---|
| 1,685,358 | 9/1928 | Harcourt | 40/416 |
| 2,137,371 | 11/1938 | Marsh | 46/120 |
| 3,475,853 | 11/1969 | Adler | 446/330 |
| 3,648,405 | 3/1972 | Tepper | 446/330 |
| 3,740,894 | 6/1973 | Howland et al. | 446/383 |
| 3,928,934 | 12/1975 | Lewis et al. | 46/119 |
| 4,003,158 | 1/1977 | Wolf et al. | 446/334 |
| 4,217,726 | 8/1980 | Flicker et al. | 46/120 |
| 4,571,206 | 2/1986 | Mayer et al. | 446/330 |
| 4,579,542 | 4/1986 | Mayer et al. | 446/330 |
| 4,596,532 | 6/1986 | Cook et al. | 446/330 |

FOREIGN PATENT DOCUMENTS

| | | | |
|---|---|---|---|
| 0150283 | 8/1985 | European Pat. Off. | 446/330 |
| 672206 | 10/1964 | Italy . | |
| 1412636 | 5/1975 | United Kingdom | 446/317 |
| 2115301 | 9/1983 | United Kingdom | 446/354 |

*Primary Examiner*—Robert A. Hafer
*Assistant Examiner*—D. Neal Muir
*Attorney, Agent, or Firm*—Ronald M. Goldman; Melvin A. Klein; Daniel F. Sullivan

[57] ABSTRACT

A toy doll having arms which move in response to the upper torso of the doll being pivoted about a horizontal axis. As the upper torso of the doll is tilted back and forth, a pin engaged to the lower torso of the doll slidably engages the upper curved surfaces of a cam support mounted in the upper torso causing a forked plate rotatably mounted on the support to rotate back and forth. Rotation of the forked plate causes a crown gear to rotate which engages two gears with detents rotatably mounted on a shaft. As a result, the two gears with detents rotate in opposite directions causing arm connectors attached to the doll's arms to also rotate in opposite directions. As such, the doll's arms move back and forth in opposite directions as the upper torso is tilted back and forth. A spring disposed around the shaft and between the two gears with detents allows the two gears to disengage from the arm connectors preventing damage to the doll when the arms of the doll are twisted improperly by a child.

8 Claims, 3 Drawing Figures

12
46
104
40
74
78
70
80
72
76
69
64
56
68
86
66
54
58
100
60
54
62
82
91
93
20
84
95
22
90
102
88
14

TOY DOLL HAVING ARTICULATED ARMS AND A TILTABLE UPPER TORSO

BACKGROUND OF THE INVENTION

This invention relates to animated dolls, and more particularly, to a toy doll having arms which move in response to the upper torso of the doll being pivoted about a horizontal axis.

In the past, different mechanisms have been used to produce dolls or manikins with articulated limbs, heads and torsos. For example, dolls featuring arms which move as a result of leg movement are disclosed in U.S. Pat. No. 4,579,542 issued to Mayer, et al on Apr. 1, 1986 and Italian Pat. No. 672206 issued to Ong and dated Oct. 26, 1964. Dolls having heads which move in response to leg or arm movement are described in U.S. Pat. Nos. 4,217,726 issued to Flicker, et al on Aug. 19, 1980; 3,475,853 issued to Adler on Nov. 4, 1969 and 2,137,371 issued to Marsh on Nov. 22, 1938. U.S. Pat. No. 3,928,934 issued to Lewis, et al on Dec. 30, 1975 features a control lever used for controlling rotation and tilting of upper and lower torso members of a doll with respect to each other. A doll having arms which may be moved by twisting its torso about a vertical axis is disclosed in U.S. Pat. No. 3,648,405 issued to Tepper on Mar. 14, 1972. Fianlly, U.S. Pat. No. 1,685,358 issued to Harcourt on Sept. 25, 1928 describes a manikin having a coil spring at its waist.

None of the above patents discloses a doll having arms which move in response to its upper torso being pivoted or tilted about a horizontal axis. A child could play with such a doll by grasping the upper torso and tilting it back and forth while the feet of the doll are placed on a supporting surface, resulting in continuous movement of the doll's arms. As a result, the child can pretend that the doll is dancing as the arms move back and forth in response to the tilting movement of the upper torso. Accordingly, there is a need in the toy manufacturing arts for a toy doll having articulated arms which move as the upper torso of the doll is tilted about a horizontal axis.

SUMMARY OF THE INVENTION

It is an object of this invention to provide a toy doll having articulated arms which move in response to the upper torso of the doll being rotated or tilted about a horizontal axis.

It is another object of this invention to provide a toy doll having articulated arms which can be twisted by a child without causing damage to the mechanism used for the doll.

These and other objects and advantages are attained by a toy doll having arms which move in response to the upper torso of the doll being pivoted about a horizontal axis. As the upper torso of the doll is tilted back and forth, a pin engaged to the lower torso of the doll slidably engages the upper curved surfaces of a cam support mounted in the upper torso causing a forked plate rotatably mounted on the support to rotate back and forth. Rotation of the forked plate causes a crown gear to rotate which engages two gears with detents rotatably mounted on a shaft. As a result, the two gears with detents rotate in opposite directions causing arm connectors attached to the doll's arms to also rotate in opposite directions. As such, the doll's arms move back and forth in opposite directions as the upper torso is tilted back and forth. A spring disposed around the shaft and between the two gears with detents allows the two gears to disengage from the arm connectors preventing damage to the doll when the arms of the doll are twisted improperly by a child.

Various features of the present invention will be best understood, together with further objects and advantagegs by reference to the following description of the preferred embodiment, taken in conjunction with the accompanying drawings.

DESCRIPTION OF THE PREFERRED EMBODIMENT

The following specification taken in conjunction with the drawings sets forth the preferred embodiment of the present invention in such a manner that any person skilled in the toy manufacturing arts can use the invention. The embodiment of the invention disclosed herein is the best mode contemplated by the inventors for carrying out their invention in a commercial environment, although it should be understood that various modifications can be accomplished within the parameters of the present invention.

Figure 1:
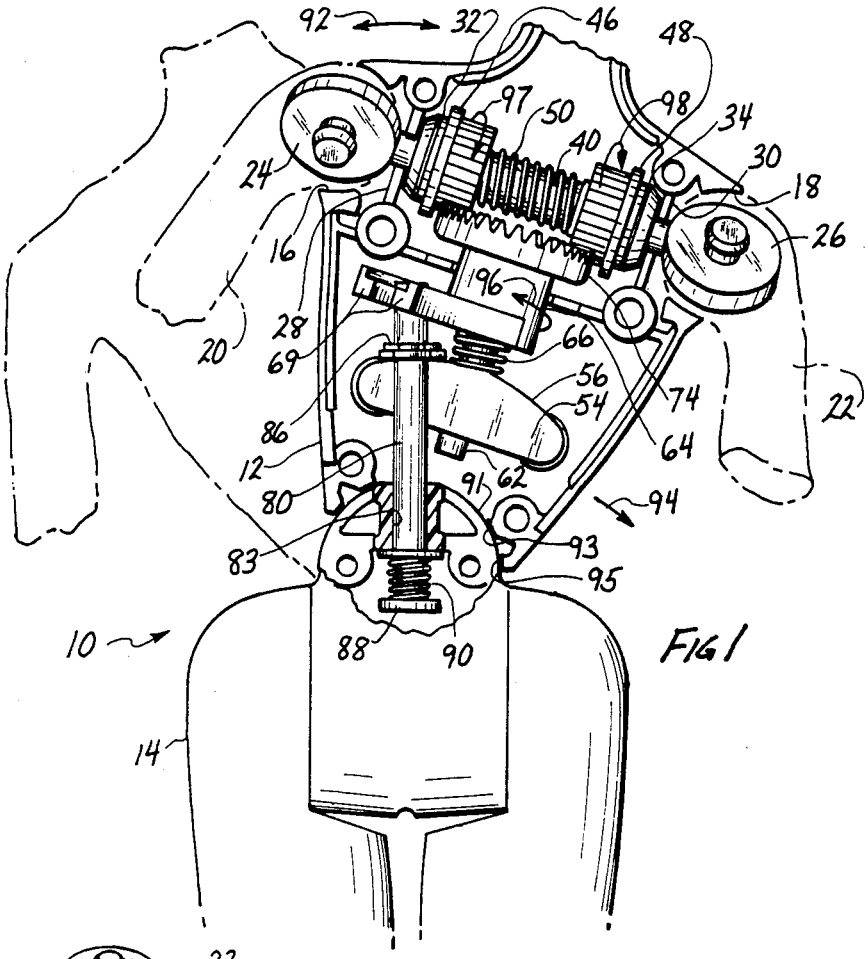
FIG. 1 is a front elevational view of the preferred embodiment of the toy doll of the present invention showing a mechanism with gears mounted inside the upper torso of the doll.
Figure 3:
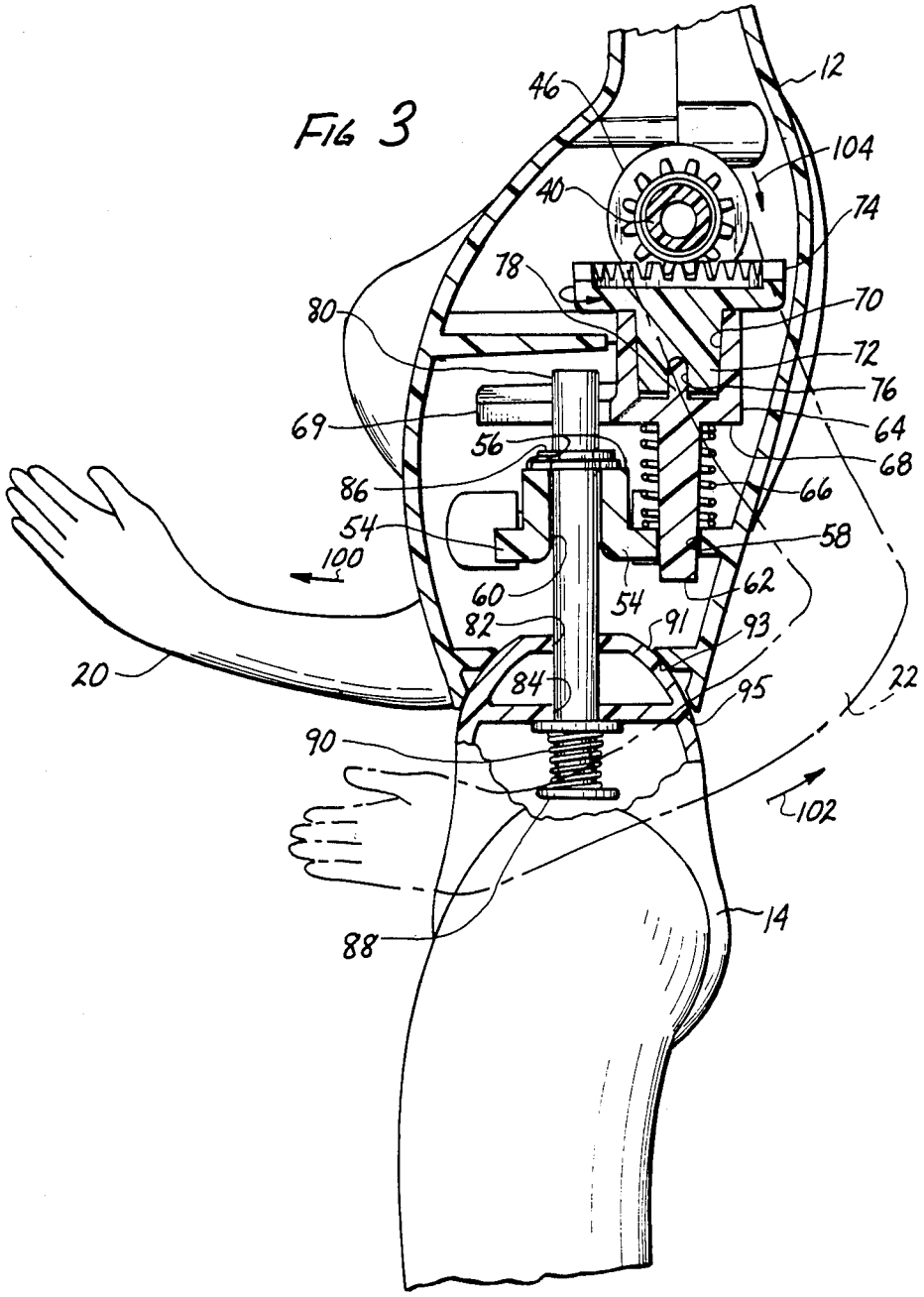
FIG. 3 is a side elevational view in partial cross-section of the doll of FIG. 1.

Referring now to the drawings and particularly to FIGS. 1 and 3, a preferred embodiment of the toy doll 10 of the present invention is disclosed. The doll 10 has upper and lower torsos 12 and 14, respectively. The upper torso 12 is hollow having apertures 16 and 18 therein and preferably fabricated using front and rear portions held together by pin and socket connectors, or the like. Arms 20 and 22 rotatably engage the apertures 16 and 18 as shown in FIG. 1. Arm connectors 24 and 26 are connected to the arms 20 and 22, respectively. The arm conectors 24 and 26 are rotatably mounted in supporting webs 28 and 30.

Figure 2:
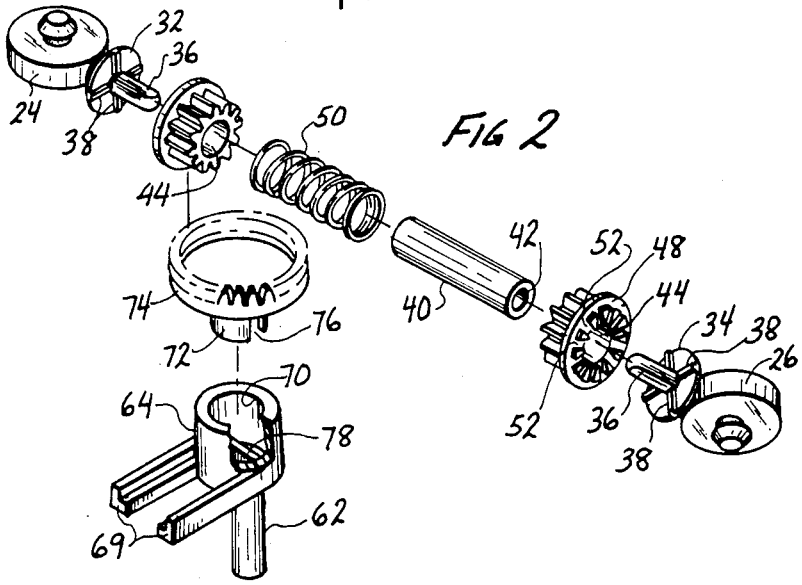
FIG. 2 is an exploded perspective view of a shaft-arm assembly, crown gear and fork plate used for the doll of FIG. 1.

FIG. 2 showns an exploded perspective view of a shaft-arm assembly used for the doll 10. As shown, the connectors 24 and 26 have disk-shaped portions 32 and 34 attached thereto. Each of the portions 32 and 34 has an extension 36 and a plurality of elongated ridges 38 attached to it. A shaft 40 with longitudinal aperture 42 is used for the assembly. Note that the shaft 40 may have apertures exiting both its ends instead of one longitudinal aperture if desired. When assembled, extensions 36 rotatably engage aperture 42 in the shaft 40. The shaft 40 is assembled so that it engages apertures 44 in two gears with detents 46 and 48 which are rotatably mounted on the shaft. A spring 50 disposed about the shaft 40 is located between the gears 46 and 48.

Each of the gears with detents 46 and 48 has a plurality of protuberances on one side thereof forming a plurality of slots 52 as shown in FIG. 2. Note gear 46 has protuberances with slots 52 similar to those of gear 48. When assembled, the elongated ridges 38 releasably engage slots 52 as explained below.

A cam support 54 is attached to the upper torso 12. The cam support has curved upper surfaces 56, an aperture 58 and a channel 60 as shown in FIGS. 1 and 3. It is important to note that the cam support 54 can be attached to the torso 12 using any desirable means and can be fabricated out of one or more parts so long as the curved surfaces 56 and channel 60 are provided.

A downward extension 62 of the forked plate 64 rotatably engages aperture 58 in the cam support 54 as shown in FIG. 3. The forked plate 64 is held in place by a spring 66 disposed around extension 62 and located between the cam support 54 and surface 68 of the plate. The forked plate 64 has two arms 69 extending outward therefrom and an aperture 70 extending partially into it which is engaged by a downward extension 72 of a crown gear 74. Preferably, a slot 76 in extension 74 engages a ridge 78 at the bottom of aperture 70. Note that any other desirable means may be used to join the crown gear 74 and forked plate 64 together. When assembled, the spring 66 biases the crown gear 72 into engagement with the gears 46 and 48.

Referring again to FIG. 3, a vertical pin 80 passes through apertures 82 and 84 in the lower torso 14 and channel 60 in the cam support 54. Note, alternatively, pin 80 may pass through a single aperture 83 as shown in FIG. 1 if desired. Top and bottom flanges 86 and 88, respectively, are attached to pin 80. The pin 80 is held in place by flange 86 which slidably engages curved surfaces 56 of the cam support 54 and a spring 90 trapped between flange 88 and torso 14 which biases flange 86 against surfaces 56. The top end of the pin 80 fits between arms 69 of the forked plate 64 as shown in FIGS. 1 and 3.

A child may play with the doll 10 by grasping the upper torso 12 and tilting or rotating it back and forth in the directions of arrows 92 shown in FIG. 1. Such rotational movement of the upper torso 12 with respect to the lower torso 14 is made possible by curved surface 91 of the lower torso which rotatably engages apertures 93 and 95 in the upper torso, effectively functioning like a ball and socket joint. When rotated in this fashion, the torso 12 will be rotating about a substantially horizontal axis since rotation of the torso will be guided by pin 80 which slidably engages channel 60. If the torso 12 is tilted to the right in the direction of arrow 94, then pin 80 will force the arms 69 and the crown gear 74 to rotate in the direction of arrow 96 as flange 86 slidably engages the top of curved surfaces 56. Rotation of the crown gear 74 will cause gears 46 and 48 to rotate in accordance with arrows 97 and 98, respectively, as shown in FIG. 1. The arm connectors 24 and 26 will then cause the arms 20 and 22 to rotate in the same directions as arrows 97 and 98 since elongated ridges 38 are engaged to slots 52. If the upper torso 12 is tilted in a direction opposite to arrow 94, then the arms 20 and 22 will rotate in the opposite directions as illustrated by arrows 100 and 102 in FIG. 3. In such a case, gear 46 will rotate in the direction of arrow 104.

The elongated ridges 38 of portions 32 and 34 releasably engage the slots 52 of the gears 46 and 48 due to the action of spring 50 which biases these parts together. However, ridges 38 will disengage from slots 52, if necessary, as spring 50 compresses in order to prevent damage to the doll, for example, when a child rotates one of the arms 20 and 22 too far or in the wrong direction when playing with the doll. As such, the elongated ridges 38 and slots 52 function like a built-in clutch.

The above description discloses the preferred embodiment of the present invention. However, persons of ordinary skill in the toy field are capable of numerous modifications once taught these principles. Accordingly, it will be understood by those skilled in the art that changes in form and details may be made to the above-described embodiment without departing from the spirit and scope of the invention.

We claim:

1. A toy doll comprising:
a hollow upper torso;
a lower torso rotatably engaged to said upper torso;
at least one arm rotatably mounted to said upper torso; and
means within said hollow upper torso responsive to rotation of said upper torso about a substantially horizontal axis for rotating at least one arm with respect to said upper torso, said means including:
(a) arm connector means for engaging at least one arm;
(b) a shaft rotatably engaging said arm connector means;
(c) a fork plate rotatably mounted inside said upper torso;
(d) pin means engaged to said lower torso for rotating said fork plate as a result of rotation of said upper torso about said horizontal axis;
(e) cam support means mounted inside said upper torso for guiding said pin means, said pin means slidably engaging said cam support means and said fork plate;
(f) a first gear engaged to said fork plate and rotatable therewith; and
(g) a second gear rotatably mounted on said shaft and rotatable with said arm connector means, said second gear meshing with said first gear.

2. The toy doll of claim 1 further comprising spring means disposed around said shaft for biasing said second gear into engagement with said arm connector means.

3. The toy doll of claim 2 further comprising clutch means for releasably engaging said second gear to said arm connector means.

4. A toy doll, comprising:
a hollow upper torso;
a lower torso rotatably engaged to said upper torso;
at least one arm rotatably mounted to said upper torso;
means for coupling said upper torso to said lower torso to allow said upper torso to rotate about a substantially horizontal axis, said coupling means including (a) a fork plate rotatably mounted inside said upper torso, (b) pin means engaged to said lower torso for rotating said fork plate as a result of rotation of said upper torso about said horizontal axis, and (c) cam support means mounted inside said upper torso for guiding said pin means, said pin means slidably engaging said cam support means and said fork plate; and
gear means for transmitting torsion from said coupling means to said at least one arm as a result of rotating said upper torso about said horizontal axis.

5. The toy doll of claim 4 wherein said gear means comprises:
arm connector means for engaging at least one arm;
a shaft rotatably engaging said arm connector means;
a first gear rotatably mounted on said shaft and rotatable with said arm connector means; and
a second gear meshing with said first gear and engaging said fork plate, said cam support means having curved upper surfaces and a channel, said pin means slidably engaging said curved upper surfaces and said channel.

6. The toy doll of claim 5 further comprising spring means disposed around said shaft for biasing said first gear into engagement with said arm connector means.

7. The toy doll of claim 6 further comprising clutch means for releasably engaging said first gear to said arm connector means.

8. A toy doll, comprising:

a hollow upper torso;

a lower torso rotatably engaged to said upper torso;

two arm connectors rotatably engaged to said upper torso, each of said arm connectors having an extension and a plurality of elongated ridges;

two arms each connected to one of said arm connectors;

a shaft rotatably engaging said extensions of said arm connectors;

two gears with detents rotatably mounted on said shaft, each of said two gears having protuberances forming a plurality of slots, said elongated ridges of said arm connectors adapted for engaging said slots;

a spring disposed around said shaft biasing said elongated ridges into engagement with said slots;

a cam support mounted in said upper torso, said cam support having curved upper surfaces and a channel;

a forked plate having a downward extension rotatably engaging an aperture in said cam support, two arms extending outward therefrom and an aperture extending partially therein with a ridge at the bottom thereof;

a crown gear meshing with said two gears with detents, said crown gear having a downward extension with a slot therein engaging said aperture and ridge of said forked plate; and a pin engaged to said lower torso, said pin slidably engaging said channel in said cam support and said two arms of said forked plate.

* * * * *